US011054759B2

(12) United States Patent
Kawanishi

(10) Patent No.: US 11,054,759 B2
(45) Date of Patent: Jul. 6, 2021

(54) IMAGE FORMING APPARATUS

(71) Applicant: SHARP KABUSHIKI KAISHA, Sakai (JP)

(72) Inventor: Tomoyuki Kawanishi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/884,770

(22) Filed: May 27, 2020

(65) Prior Publication Data

US 2020/0401072 A1 Dec. 24, 2020

(30) Foreign Application Priority Data

Jun. 18, 2019 (JP) ..... JP2019-112902

(51) Int. Cl.

| | |
|---|---|
| ***G03G 15/02*** | (2006.01) |
| ***G03G 15/06*** | (2006.01) |
| *G03G 15/00* | (2006.01) |
| *G03G 15/20* | (2006.01) |
| *G03G 15/01* | (2006.01) |

(52) U.S. Cl.

CPC ..... *G03G 15/0266* (2013.01); *G03G 15/065* (2013.01); *G03G 15/0189* (2013.01); *G03G 15/2003* (2013.01); *G03G 15/5037* (2013.01)

(58) Field of Classification Search

CPC ..... G03G 15/065; G03G 15/0266

See application file for complete search history.

(56) References Cited

U.S. PATENT DOCUMENTS

2010/0135685 A1* 6/2010 Chang ..... G03G 15/065 399/55
2014/0169840 A1* 6/2014 Yokoyama ..... G03G 15/0136 399/298
2016/0306300 A1* 10/2016 Hamada ..... G03G 15/0942

FOREIGN PATENT DOCUMENTS

JP 2017-076066 A 4/2017

* cited by examiner

*Primary Examiner* — Thomas S Giampaolo, II
(74) *Attorney, Agent, or Firm* — ScienBiziP, P.C.

(57) ABSTRACT

An image forming apparatus includes a photoconductor, a charger; a charge voltage applier that applies first and second charge voltages to the charger; an exposure device; a development device; a development voltage applier that applies first and second development voltages to the development device; a transfer device; a fixing device; a motor that drives the photoconductor simultaneously with at least one of the transfer device, the fixing device, and the transporter; and a controller. When the motor is driven for image formation, the first charge voltage and the first development voltage are respectively applied to the charge voltage applier and the development voltage applier. When the motor is driven for an operation other than image formation, the second charge voltage and the second development voltage are respectively applied to the charge voltage applier and the development voltage applier.

6 Claims, 14 Drawing Sheets

FIG. 10

| CHARGE VOLTAGE | COEFFICIENT |
|---|---|
| LOWER THAN DISCHARGE START VOLTAGE | 0.6 |
| HIGHER THAN OR EQUAL TO DISCHARGE START VOLTAGE | 1.0 |

IMAGE FORMING APPARATUS

BACKGROUND OF THE INVENTION

Field of the Invention

The present invention relates to an image forming apparatus.

Description of the Background Art

Conventionally, some models of inexpensive copiers used in small offices, such as SOHO, consist of minimum numbers of parts. Some examples of such inexpensive models include image forming apparatuses, such as copiers and printers. Such an image forming apparatus controls its components with a single motor. The components include a photoconductor, a charger, a transfer device, a fixing device, and a transporter.

Since such an image forming apparatus controls several components with one motor, the number of motors required to drive the apparatus is reduced. Such image forming apparatuses having a reduced number of motors are available as inexpensive models and contribute to cost reduction.

In the case where several components are controlled by a single motor, the components are driven in the same manner. Therefore, even when a component such as the photoconductor does not have to be driven, it is driven together with the other components. In such a case, various failures may occur that would not occur when the components are driven by multiple motors (when the components are driven separately by respective motors). Typically, the photoconductor and the other components are driven separately. However, when the components are driven in the same manner by a single motor, as required in an inexpensive model, the photoconductor is unnecessarily driven (rotated). This may lead to deterioration of the surface of the photoconductor.

As a conventional invention related to the prevention of such deterioration of a photoconductor, an image forming apparatus is proposed (for example, refer to Japanese Unexamined Patent Application Publication No. 2017-076066). If a new-cartridge detector of such a conventional image forming apparatus determines that a process cartridge B is a new process cartridge, a photoconductor is started to be driven while a voltage smaller than a discharge start voltage is applied to a charge member. In this way, the charge member can be prevented from rubbing against the photoconductor.

However, a conventional method of preventing the deterioration of a photoconductor involves deterioration caused by the operation of the photoconductor during image formation. Therefore, there has been a need for a new method of suppressing the deterioration of a photoconductor in an image forming apparatus that controls the photoconductor and other components with one motor, even when the photoconductor is driven for an operation other than image formation.

An object of the present invention, which has been made in consideration of the above circumstances, is to provide an image forming apparatus that controls a photoconductor and other components with one motor and is able to suppress the deterioration of the photoconductor even when the photoconductor is driven for an operation other than image formation.

SUMMARY OF THE INVENTION (1) According to the present invention, an image forming apparatus includes a photoconductor, a charger, a charge voltage applier, an exposure device, a development device, a development voltage applier, a transfer device, a fixing device, a transporter, a motor, and a controller. The charger comes into contact with the photoconductor and charges the photoconductor. The charge voltage applier applies a first charge voltage and a second charge voltage, which are predetermined, to the charger. The exposure device forms an electrostatic latent image on the photoconductor. The development device supplies a toner to the photoconductor and forms a toner image corresponding to the electrostatic latent image. The development voltage applier applies a first development voltage and a second development voltage, which are predetermined, to the development device. The transfer device transfers the toner image onto a recording medium via a transfer belt. The fixing device heats and fixes the toner image on the recording medium by a fixing roller. The transporter transports the recording medium. The motor drives the photoconductor simultaneously with more than at least one of the transfer device, the fixing device, and the transporter. The controller that controls the photoconductor, the charger, the charge voltage applier, the exposure device, the development device, the development voltage applier, the transfer device, the fixing device, the transporter, and the motor, and forms an image. When the motor is driven for image formation, the controller applies the first charge voltage set for image formation to the charge voltage applier and the first development voltage set for image formation to the development voltage applier. When the motor is driven for an operation other than image formation, the controller applies the second charge voltage set for operations other than image formation to the charge voltage applier and the second development voltage set for operations other than image formation to the development voltage applier.

The term "image forming apparatus" in the present invention refers to an apparatus that forms and outputs an image, such as a copier or a multifunction device that has a copy function (e.g., a printer that forms a toner image through an electrophotographic scheme), or a multifunction peripheral (MFP) that has functions besides the copy function. The phrase "for image formation" may refer to image quality control besides image formation. The phrase "for an operation other than image formation" refers to, for example, idling for transportation of a recording medium or idling for temperature control.

In the first embodiment, a "photoconductor" according to the present invention is realized by a photoconductor drum 59. A "charger" according to the present invention is realized by a charge roller 60. An "exposure device" according to the present invention is realized by an optical system unit 50. A "development device" according to the present invention is realized by a development unit 61. A "transfer device" according to the present invention is realized by a primary transfer unit 62. A "transporter" according to the present invention is realized by feed rollers 73 and 74 and ejection roller ER.

SUMMARY OF INVENTION

According to the present invention, an image forming apparatus controls the photoconductor and at least one of a transfer device, a fixing device, and a sheet transport device with one motor and reduces deterioration of a photoconductor even when the photoconductor is driven for a purpose other than image formation.

Preferred modes of the present invention will be described in the following.

(2) In the image forming apparatus according to the present invention, the second charge voltage may be a predetermined voltage lower than a discharge start voltage at which a potential of the photoconductor is 0 V, and the second development voltage may be a predetermined voltage having a polarity opposite to the polarity of the first development voltage.

In this way, the image forming apparatus, which controls a photoconductor and at least one of a transfer device, a fixing device, and a sheet transporter with a single motor, is able to suppress the deterioration of the photoconductor even when the photoconductor is driven for an operation other than image formation and prevents the generation of a reverse current flowing to the board.

(3) In the image forming apparatus according to the present invention, the controller may cause the charge voltage applier to correct the charge voltage based on a value obtained by calculating an amount of drive of the photoconductor and adding a predetermined coefficient, in accordance with the first charge voltage and the second charge voltage, and the amount of drive.

In this way, the image forming apparatus, which controls a photoconductor and at least one of a transfer device, a fixing device, and a sheet transporter with a single motor, is able to predict the amount of scraping of the photoconductor in accordance with the drive amount of the photoconductor and thereby correct the charge voltage to be applied to the charger, so as to apply an appropriate charge voltage in accordance with the degree of deterioration of the photoconductor.

(4) The image forming apparatus according to the present invention may further include a photoconductor neutralizer that removes a charge from the photoconductor; and a transfer applier that applies a first transfer voltage and a second transfer voltage, which are predetermined, to the transfer device. When the motor is driven for image formation, the controller may cause the transfer applier to apply the first transfer voltage set for image formation to the transfer device and may cause the photoconductor neutralizer to remove charges from the photoconductor. When the motor is driven for an operation other than image formation, the controller may cause the transfer applier to apply the second transfer voltage set for an operation other than image formation and may cause the photoconductor neutralizer to remove charges from the photoconductor. The second transfer voltage may be a predetermined voltage having a polarity opposite to the polarity of the first transfer voltage.

In this way, even when some of the toners in the developing agent has a low charge, the image forming apparatus, which controls a photoconductor and at least one of a transfer device, a fixing device, and a sheet transporter with a single motor, is able to prevent the toner having a low charge from adhering to the photoconductor and prevent charging of the photoconductor by the voltage applied to the transfer device by a photoconductor neutralizer.

(5) In the image forming apparatus according to the present invention, the photoconductor may include a plurality of photoconductors for black and color toners. The transfer device may include an intermediate transfer body that switches between three contact states of the transfer device and the plurality of photoconductors. The three contact states may include a first state in which the transfer device is separated from all color photoconductors, a second state in which the transfer device is in contact with the black photoconductor, and a third state in which the transfer device is in contact with all color photoconductors. The controller may cause the three contact states of the intermediate transfer body to switch in a predetermined order.

In the image forming apparatus that controls a photoconductor and at least one of a transfer device, a fixing device, and a sheet transporter with a single motor, the photoconductor is driven at a voltage lower than the discharge start voltage. In this way, the waiting time for the rise in the electric potential on the photoconductor can be omitted, thereby reducing the required time. Since no discharge is performed, the energization fatigue of the photoconductor is also reduced, and thereby wear can be suppressed.

BRIEF DESCRIPTION OF THE DRAWINGS

FIG. 10 illustrate example coefficients predetermined in accordance with the voltage applied to the charge roller in the digital multifunction peripheral according to the second embodiment of the present invention;

FIG. 12A illustrates the intermediate transfer belt and the four photoconductor drums in a separated state, FIG. 12B illustrates the intermediate transfer belt and the black photoconductor drum in contact with each other, and FIG. 12C illustrates the intermediate transfer belt and the four photoconductor drums in contact with each other.

DESCRIPTION OF THE PREFERRED EMBODIMENTS

The present invention will now be described in detail with reference to the accompanying drawings. Note that the following explanations are mere examples in all respects, and should not be construed as limiting the present invention.

First Embodiment

Structure of Digital Multifunction Peripheral 1

Figure 1:
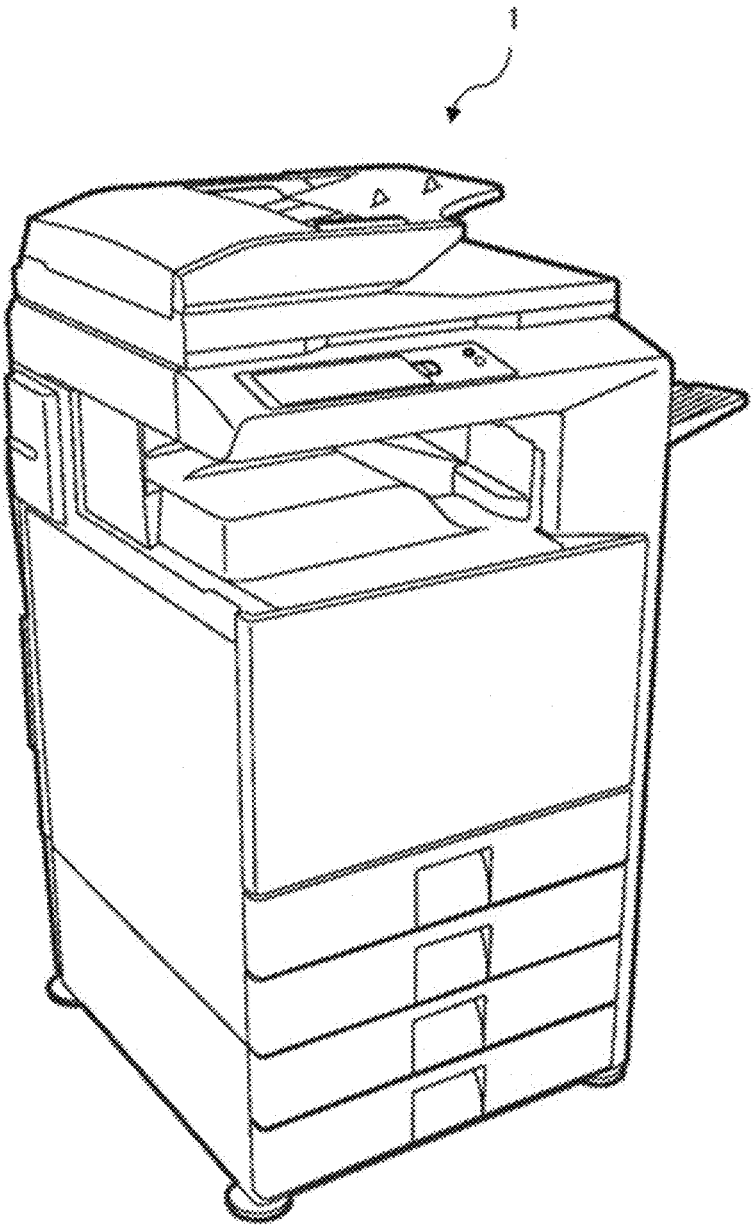
FIG. 1 is an external perspective view of a digital multifunction peripheral according to a first embodiment of the present invention.
Figure 2:
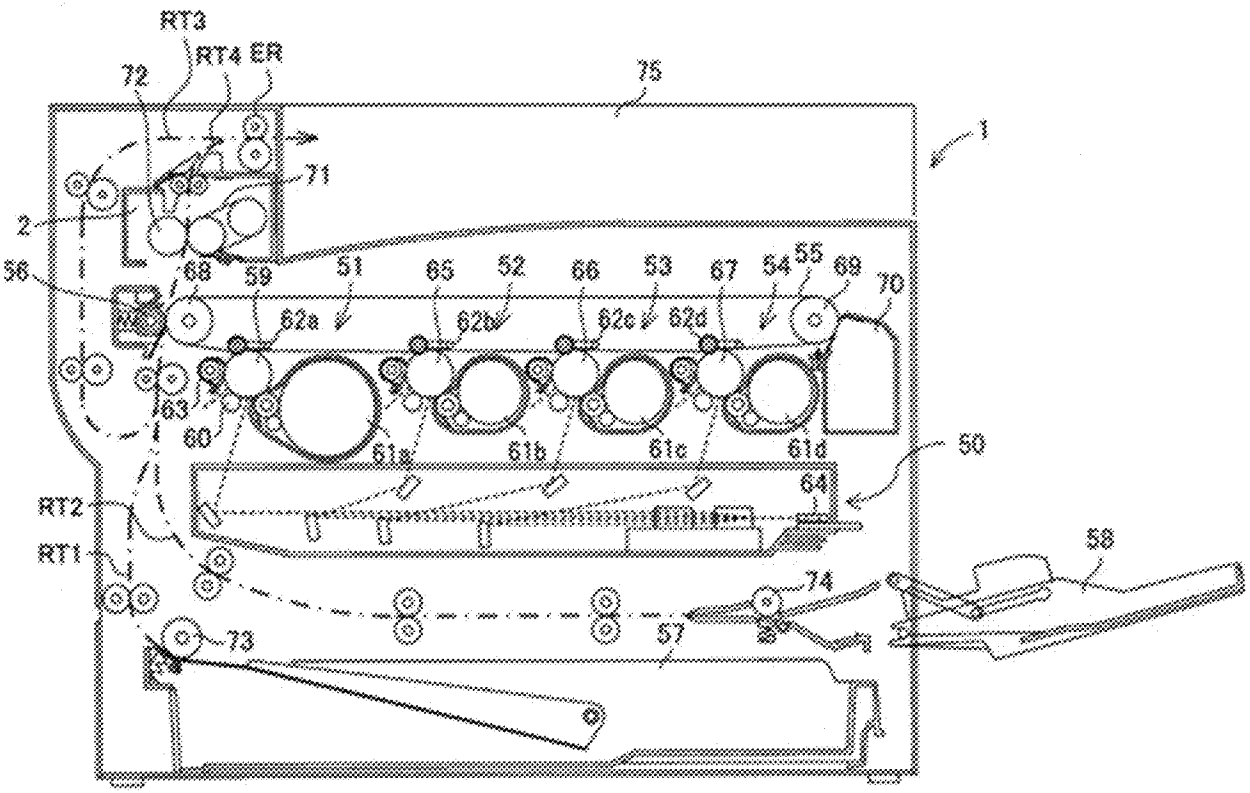
FIG. 2 is a cross-sectional view of the internal configuration of the digital multifunction peripheral of FIG. 1.

An outline of a digital multifunction peripheral 1 as an example of an image forming apparatus according to the first embodiment of the present invention will now be described with reference to FIGS. 1 and 2. FIG. 1 is an external perspective view of the digital multifunction peripheral 1 according to the first embodiment of the present invention. FIG. 2 is a cross-sectional view of the internal configuration of the digital multifunction peripheral 1 of FIG. 1.

The digital multifunction peripheral 1 is an apparatus including a copy function, a scanner function, and a facsimile function. The digital multifunction peripheral 1 digitally processes an image data read from a document and outputs a corresponding image.

The digital multifunction peripheral 1 includes a copy function, a print function, and a facsimile function as printing modes. A controller 10 (see FIG. 3) selects a printing mode corresponding to an operation input from a panel unit 18 (see FIG. 3) or a print job from an external device, such as a personal computer.

Internal Configuration of Digital Multifunction Peripheral 1

With reference to FIG. 2, the digital multifunction peripheral 1 is a color multifunction peripheral. The digital multifunction peripheral 1 includes an optical system unit 50, first to fourth visible-image forming units 51 to 54, an intermediate transfer belt 55, a secondary transfer unit 56, a fixing device 2, an internal sheet feeding unit 57, a manual sheet feeding unit 58, and a sheet receiving tray 75.

The digital multifunction peripheral 1 uses the first to fourth visible-image forming units 51 to 54, the intermediate transfer belt 55, and the secondary transfer unit 56 to form a toner image.

In the optical system unit 50, four laser light sources 64 are arranged so that the laser beams from the laser light sources 64 reach the four photoconductor drums 59, 65, 66, and 67.

The first visible-image forming unit 51 includes the photoconductor drum 59, a charge roller 60, the optical system unit 50, a development unit 61*a*, and a primary transfer unit 62*a*.

The charge roller 60, the development unit 61*a*, and a cleaning unit 63 are disposed around the photoconductor drum 59 serving as an image carrier.

These units form a toner image on the photoconductor drum 59 and transfer the toner image onto the intermediate transfer belt 55.

The photoconductor drum 59 is an image carrier on which a toner image is formed. The photoconductor drum 59 is rotatably supported around the axis. The photoconductor drum 59 includes a cylindrical, columnar, or thin-film (preferably cylindrical) conductive substrate (not illustrated) and a photoconductor layer formed on the surface of the conductive substrate.

The photoconductor drum 59 is rotated in a direction corresponding to the counterclockwise direction in FIG. 2 by a photoconductor-drum drive gear (not illustrated) fixed to the photoconductor drum 59 engaged with a motor gear. The photoconductor drum 59 rotates at a circumferential velocity of, for example, 163 mm/s.

The primary transfer unit 62*a* is disposed so as to be pressed against the photoconductor drum 59 via the intermediate transfer belt 55.

The other second to fourth visible-image forming units 52 to 54 have the same configuration as the first visible-image forming unit 51, so the description thereof is omitted.

Development units 61*a*, 61*b*, 61*c*, and 61*d* of the respective units 51, 52, 53, and 54 respectively accommodate toners of black (B), cyan (C), magenta (M), and yellow (Y). Hereinafter, the development units 61*a*, 61*b*, 61*c*, and 61*d* of the respective colors may be represented by and referred to as a development unit 61. Primary transfer units 62*a*, 62*b*, 62*c*, and 62*d* for the respective colors may be represented by and referred to as a primary transfer unit 62.

Toner images of the respective colors are transferred onto the intermediate transfer belt 55. The color toner images of the respective colors are superimposed on the surface of the intermediate transfer belt 55. The intermediate transfer belt 55 is driven by tension rollers 68 and 69 to rotate. The secondary transfer unit 56 is disposed in contact with the intermediate transfer belt 55 on the side adjacent to the tension roller 68.

The secondary transfer unit 56 applies a high voltage having a polarity opposite to the toner charge polarity to a transfer area by a high-speed corona charger. Through such applying, the color toner images formed on the intermediate transfer belt 55 are transferred to a recording medium 31 fed from the internal sheet feeding unit 57 or the manual sheet feeding unit 58 by the feed roller 73 or 74, respectively.

The recording medium 31 on which the color toner images are transferred is transported to the position of the fixing device 2.

The toner remaining on the surface of the intermediate transfer belt 55 is collected after the secondary transfer, in a waste toner box 70 disposed in contact with the intermediate transfer belt 55 on the side adjacent to the tension roller 69.

The fixing device 2 is disposed downstream of the secondary transfer unit 56. The fixing device 2 includes a fixing belt 71 and a pressing roller 72. The pressing roller 72 is pressed against the fixing belt 71 with a predetermined pressure by a pressure mechanism (not illustrated). The sheet receiving tray 75 is disposed downstream of the fixing device 2.

Figure 3:
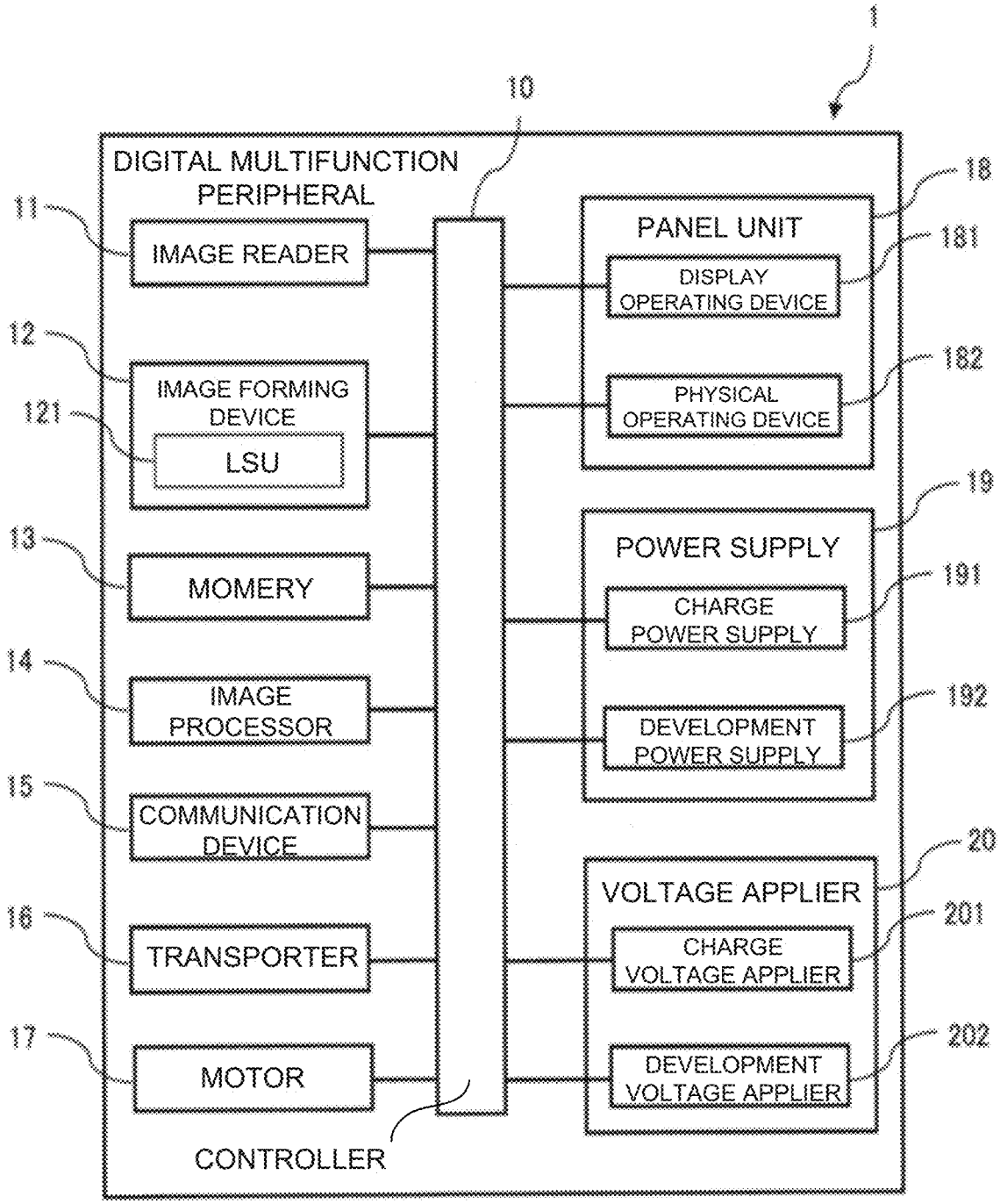
FIG. 3 is a block diagram illustrating a schematic configuration of the digital multifunction peripheral of FIG. 1.

The schematic configuration of the digital multifunction peripheral 1 will now be described with reference to FIG. 3. FIG. 3 is a block diagram illustrating the schematic configuration of the digital multifunction peripheral of FIG. 1.

As illustrated in FIG. 3, the digital multifunction peripheral 1 includes a controller 10, an image reader 11, an image forming device 12, a memory 13, an image processor 14, a communication device 15, a transporter 16, a motor 17, a panel unit 18, a power supply 19, and a voltage applier 20.

Each component of the digital multifunction peripheral 1 will now be described.

The controller 10 comprehensively controls the digital multifunction peripheral 1. The controller 10 includes a central processing unit (CPU), a random-access memory (RAM), a read-only memory (ROM), various interface circuits, etc.

The controller 10 monitors and controls all loads, such as detection of sensors, the motor, the clutch, the panel unit 18, etc., in order to comprehensively control the operation of the digital multifunction peripheral 1.

The image reader 11 detects and reads a document placed on a document set table or a document transported from the sheet tray and generates image data.

The image forming device 12 prints out the image data generated by the image processor 14 on a sheet. The image forming device 12 includes a load/store unit (LSU) 121.

The LSU 121 is a device, which irradiates the surfaces of the photoconductor drums 59, 65, 66, and 67 in a charged state with laser light corresponding to image information consisting of digital signals acquired by the image reader 11, to form an electrostatic latent image.

The memory 13 is a device or a storage medium that stores information needed for realizing various functions of the digital multifunction peripheral 1, a control program, etc. For example, the memory 13 is a storage medium, such as a semiconductor device (e.g., a RAM or a ROM), a hard disk, a flash memory, a storage media, or a solid state drive (SSD).

Note that the program and the data may be stored on different devices. For example, the area holding the data may be composed of a hard disk drive, and the area holding the program may be composed of a flash memory.

The image processor 14 converts the image of the document read by the image reader 11 into an appropriate electrical signal, to generate image data.

The communication device 15 communicates with a computer, a portable information terminal, an external information processing device, or a facsimile machine via a network, and transmits and receives various types of information, such as E-mails and facsimile to and from these external communication devices.

The transporter 16 transports a sheet stored in the manual feed tray, the sheet feed cassette, and the document set table to the image forming device 12.

The motor 17 drives the components such as the photoconductor drums 59, 65, 66, and 67, the charge roller 60, the primary transfer unit 62, and the fixing device 2. In the first embodiment, the photoconductor drums 59, 65, 66, and 67 and other components are driven by the single motor 17.

The panel unit 18 includes a liquid crystal display, a display operating device 181, and a physical operating device 182.

The display operating device 181 displays various types of information and accepts instructions from the user by the touch panel function. The display operating device 181 includes, for example, a cathode-ray tube (CRT) display, a liquid crystal display, or an electroluminescent (EL) display. The display operating device 181 is a display device, such as a monitor or a line display, that displays electronic data, such as an operating status, of the operating system and the application software. The controller 10 displays the operation and the status of the digital multifunction peripheral 1 through the display operating device 181.

The power supply 19 supplies power to the components of the digital multifunction peripheral 1. The power supply 19 is, for example, an advanced technology (AT) power supply, an advanced technology extended (ATX) power supply, or an SFX power supply. The power supply 19 includes a charge power supply 191 and a development power supply 192.

The voltage applier 20 performs applying of a voltage. The voltage applier 20 includes a charge voltage applier 201 and a development voltage applier 202. The charge voltage applier 201 applies a predetermined voltage to the charge roller 60. The development voltage applier 202 applies a predetermined voltage to a development roller 611*a*.

Image Forming Operation of Digital Multifunction Peripheral 1

Figure 4:
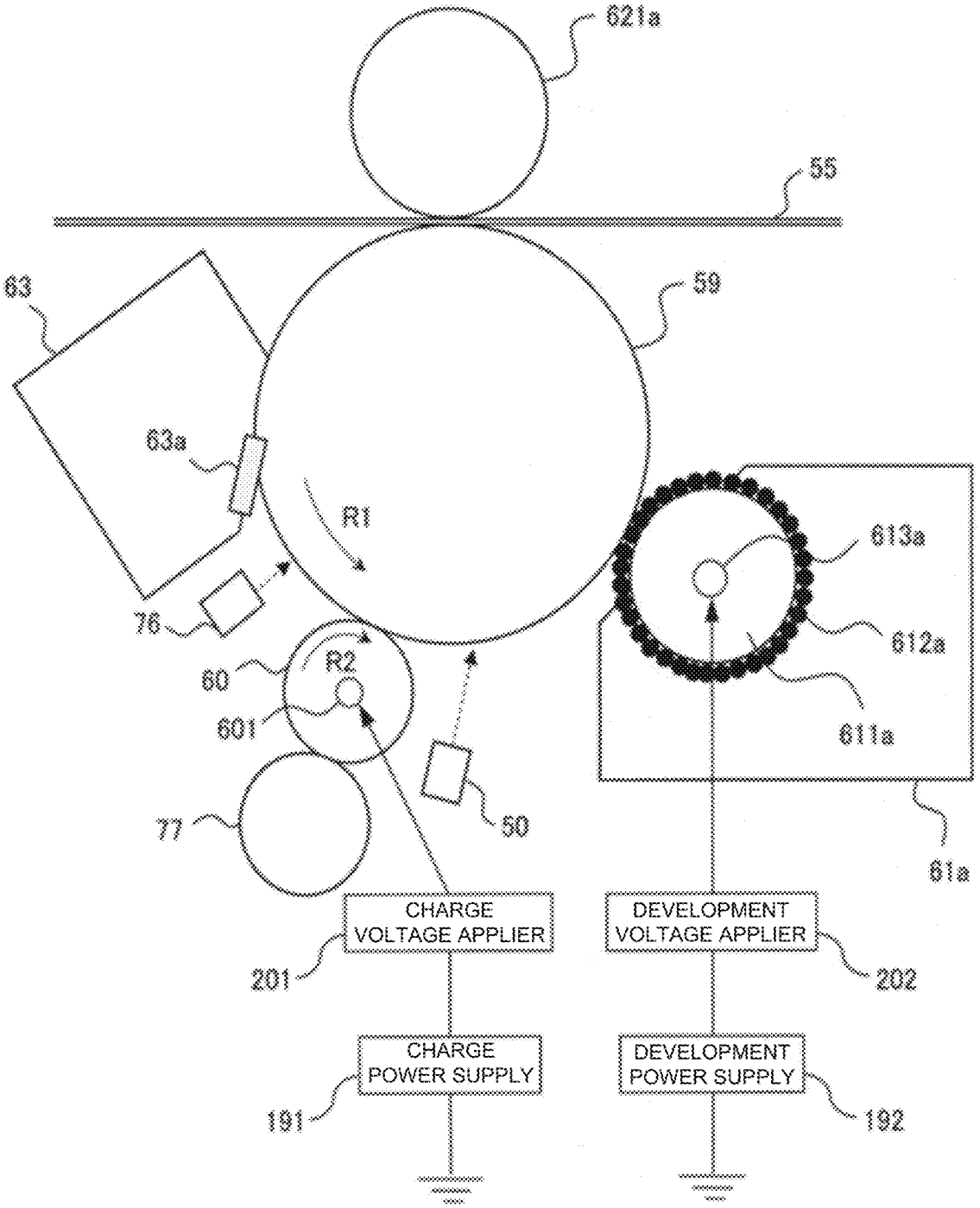
FIG. 4 is an explanatory diagram illustrating a schematic configuration of a first visible-image forming unit of the digital multifunction peripheral of FIG. 1.

The image forming operation by the digital multifunction peripheral 1 will now be described with reference to FIG. 4. FIG. 4 is an explanatory diagram illustrating a schematic configuration of the first visible-image forming unit 51 of the digital multifunction peripheral 1 of FIG. 1.

In the following description, the first visible-image forming unit 51 will be described as an example. The same description also applies to the second to fourth visible-image forming units 52 to 54.

In FIG. 4, the photoconductor drum 59 rotates in the rotation direction R1 (the counterclockwise direction in the drawing). The charge roller 60 receives the rotation of the photoconductor drum 59 and thereby rotates in the rotation direction R2 (the clockwise direction in the drawing). In the first embodiment, the charge roller 60 is driven by the photoconductor drum 59. Alternatively, the charge roller 60 may not be driven by the photoconductor drum 59.

During image formation, the surface of the photoconductor drum 59 is uniformly charged by the charge roller 60. The first embodiment adopts the charge roller system in order to uniformly charge the surface of the photoconductor drum 59 and to minimize the generation of ozone.

There are two charge roller systems: a contact charge system and a non-contact charge system. In the contact charge system, the photoconductor drum 59 and the charge roller 60 are in contact with each other. In the non-contact charge system, the photoconductor drum 59 and the charge roller 60 are not in contact with each other. In the contact charge system, a reverse current may flow from the photoconductor drum 59 to the charge roller 60. Such a reverse current may cause a failure in the high-voltage board. The conventional scorotron charge system is a non-contact charge system. In the conventional scorotron charge system, a reverse current is unlikely to flow from the photoconductor drum 59 to the charge roller 60, as described above. Therefore, the need to consider such a reverse current is small. However, in the case of the contact charge system adopted by the charge roller system of the present invention, the photoconductor drum 59 and the charge roller 60 are in contact with each other. Therefore, it is necessary to prevent a reverse current from flowing into the charge roller 60. To prevent a reverse current from flowing into the charge roller 60, the first embodiment provides a configuration in which the voltage is smaller than the discharge start voltage.

As illustrated in FIG. 4, the charge roller 60 is pressed against the surface of the photoconductor drum 59 by a predetermined pressure suitable for charging caused by an urging force of a spring or the like (not illustrated). The charge roller 60 thereby rotates by following the rotation of the photoconductor drum 59.

The charge voltage applier 201 applies a predetermined charge voltage from the charge power supply 191 (high-voltage power supply circuit) to a core metal 601 of the charge roller 60. The surface of the photoconductor drum 59 is thereby charged with a predetermined voltage (for example, −600 V). In the first embodiment, the surface potential Vd of the charged photoconductor drum 59 is −600 V.

The optical system unit 50 causes the surface of the charged photoconductor drum 59 to be exposed to a beam from the laser light source 64 and thereby reduce the surface potential VL of the photoconductor drum 59 after exposure. The surface potential VL is reduced to, for example, −100 V or lower to form an electrostatic latent image. In the first embodiment, the surface potential VL of the photoconductor drum 59 is −100 V after exposure.

Note that, although the present invention may employ either a regular development scheme or an inverted development scheme, the inverted development scheme will be described in the first embodiment.

Laser light from the optical system unit 50 is applied to the photoconductor drum 59 through a polygon mirror and various lenses (not illustrated).

The laser light source 64 is controlled on the basis of the image information to form an electrostatic latent image corresponding to the image information on the surface of the photoconductor drum 59.

The development unit 61*a* develops the electrostatic latent image on the photoconductor drum 59 to form a toner image. The electrostatic latent image formed on the photoconductor drum 59 is visualized by the development unit 61*a* by a developing agent 612*a* containing toner and carrier so as to form a toner image.

As illustrated in FIG. 4, the development unit 61*a*, which is a unit for developing, is disposed facing the photoconductor drum 59. The development roller 611*a* serving as a developing agent carrier is disposed so as to be rotatable around a rotation axis parallel to the rotation axis of the photoconductor drum 59.

The development unit 61*a* is a hollow container-like member composed of, for example, hard synthetic resin. The development unit 61*a* holds ax two-component developing agent containing toner and carrier as described above. Alternatively, the development unit 61*a* may hold a one-component developing agent containing only toner.

The development roller 611*a* is a magnet roller in which magnet members having different polarities are substantially alternately disposed along the circumferential direction. The development roller 611*a* adsorbs the developing agent 612*a* held in the development unit 61*a* by the magnetic force of the development roller 611*a*. The adsorbed developing agent 612*a* is restricted by a developing agent regulating member (not illustrated) to have a predetermined thickness and is transported to a development nip where the development roller 611*a* and the photoconductor drum 59 are disposed close to each other.

The development voltage applier 202 applies a predetermined development voltage to a core metal 613*a* of the development roller 611*a* from the development power supply 192 (high voltage power supply circuit) so as to charge the development roller 611*a* with a predetermined voltage. In the first embodiment, the electric potential Vb of the development roller 611*a* is −450 V.

The development voltage is set to a value lower than the surface potential Vd (−600 V) of the non-exposed area of the photoconductor drum 59 and higher than the surface potential VL (−100 V) of the exposed area.

As a result, the toner charged to the same polarity as that of the photoconductor drum 59 (negative polarity in the first embodiment) is attracted to the surface potential VL of the exposed area of the photoconductor drum 59, to form a toner image (inverted development).

The surface potential Vd of the non-exposed area of the photoconductor drum 59 is lower than the electric potential Vb of the development roller 611*a*. This prevents toner adhesion.

A voltage is applied to a transfer roller 621*a* of the primary transfer unit 62*a*, and the voltage has a polarity opposite to that of the toner. The toner image developed on the photoconductor drum 59 is transferred to the intermediate transfer belt 55 in the transfer region in which the primary transfer unit 62*a* and the photoconductor drum 59 in proximity to each other.

In the first embodiment, the primary transfer unit 62*a* uses the intermediate transfer belt 55. Alternatively, the primary transfer unit 62*a* may use a wire.

The second to fourth visible-image forming units 52 to 54 also operate in the same way to sequentially transfer toner images onto the intermediate transfer belt 55.

The toner images on the intermediate transfer belt 55 are transported to the secondary transfer unit 56. As illustrated in FIG. 2, the recording medium 31 is fed from a feed roller 73 of the internal sheet feeding unit 57 or a feed roller 74 of the manual sheet feeding unit 58 through a transport route RT1 or RT2, respectively.

A voltage having a polarity opposite to that of the toner is applied to the toner images by the secondary transfer unit 56 so as to transfer the toner image to the recording medium 31.

The recording medium 31 carrying the toner images is transported to the fixing device 2, sufficiently heated by the fixing belt 71 and the pressing roller 72. The unfixed toner images are melted and fixed onto the recording medium 31. The recording medium 31 on which the toner images are fixed is output from an ejection roller ER to the sheet receiving tray 75 through the transport route RT4.

In double-sided printing, an image is formed on the front face of the recording medium 31 by passing through the fixing device 2. The recording medium 31 is then inverted by passing through a transport route RT3, and an image is formed on the back face of the recording medium 31.

After the image transfer, the residual toner that has not been transferred to the intermediate transfer belt 55 adheres to the photoconductor drum 59. The residual toner is scraped off by a cleaning blade 63*a* fixed to the cleaning unit 63, and is collected as a waste toner in the cleaning unit 63.

A neutralization unit 76 removes the electric charges on the surface of the photoconductor drum 59. Note that the neutralization unit 76 may be disposed at any position corresponding to after transfer and before charging.

A cleaning roller 77 is provided at a position facing the charge roller 60, and cleans the surface of the charge roller 60.

Problems of Conventional Technology

Figures 5A, 5B:
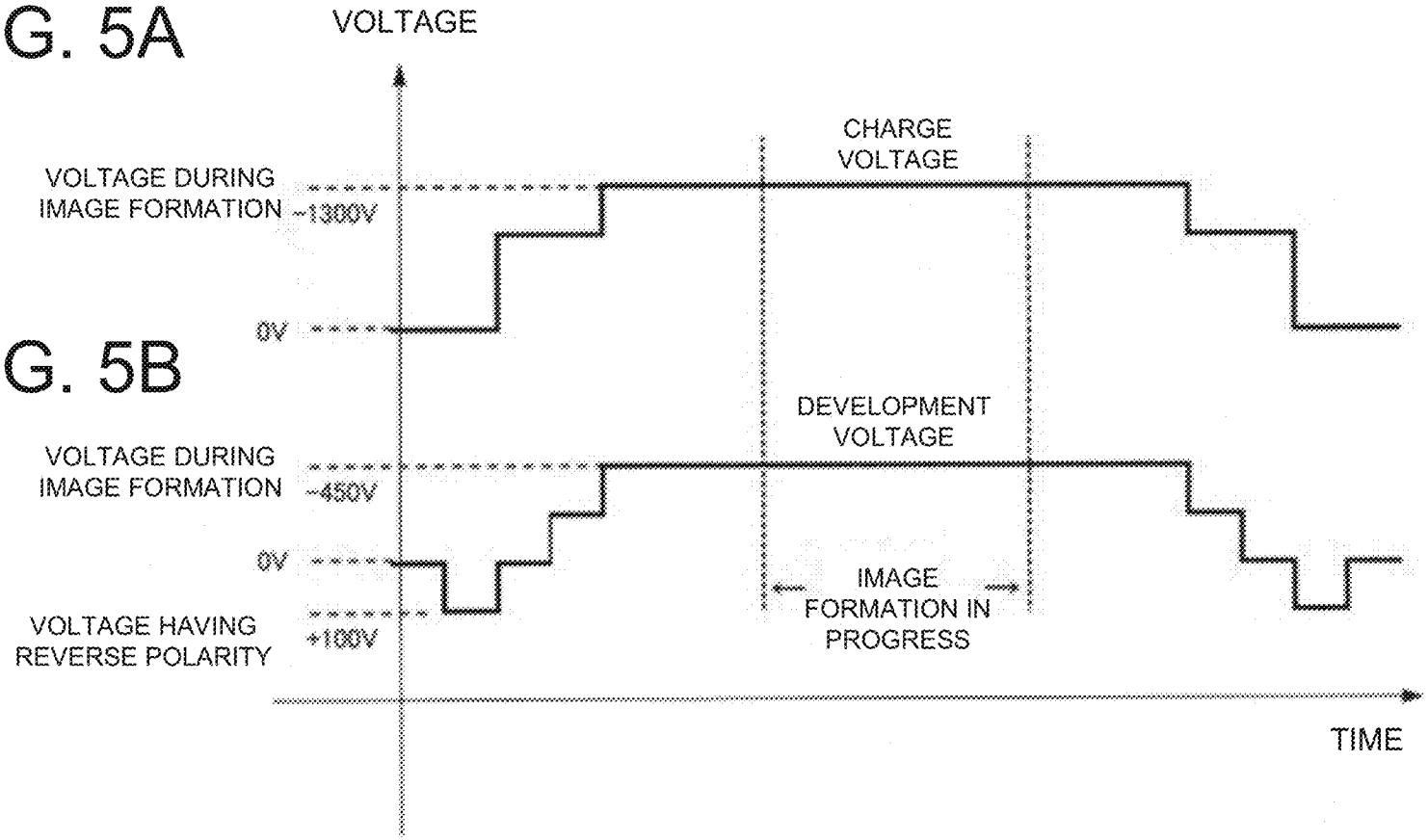
FIGS. 5A and 5B are example time charts illustrating a temporal variation in voltages to be applied to a charge roller and a development roller illustrated in FIG. 4 during image formation.

The problems of the conventional technology will now be explained with reference to FIGS. 5A and 5B. FIGS. 5A and 5B are example time charts illustrating a temporal variation in voltages to be applied to the charge roller 60 and the development roller 611*a* illustrated in FIG. 4 during image formation.

A voltage is applied to the development roller 611*a* by the development voltage applier 202. The applied voltage varies depending on the use conditions and is, for example, −450 V.

As explained above, the electrostatic latent image formed on the surface of the photoconductor drum 59 is visualized (developed) by the toner at the development nip.

However, the potential difference between the surface potential on the photoconductor drum 59 and the development voltage applied to the development roller 611*a* during the rotation before and after the visualization process varies depending on the specific configuration and the use condition. The potential difference is preferably within the range of 100 V to 150 V.

When a portion of the photoconductor drum 59 that is not charged by the charge roller 60 overlaps the development nip, the applying of a voltage that is the same as that for visualization causes unwanted toner to adhere to the photoconductor drum 59. The preferable potential difference prevents wasteful consumption of toner caused by the adhesion.

As illustrated in FIG. 5A, a voltage of −1300 V is applied to the charge roller 60 during image formation.

As illustrated in FIG. 5B, a voltage of −450 V is applied to the development roller 611*a*.

Moreover, a voltage of +100 V having a reverse polarity is applied to the development roller 611*a* before and after image formation. This is because the influence of the surface potential remaining on the surface of the photoconductor causes the voltage to be −100 V to less than −150 V before and after the leading edge of the surface potential of the photoconductor. Therefore, the potential difference between the development roller and the surface of the photoconductor needs to be maintained constant by applying a voltage having a reverse polarity.

The components of the digital multifunction peripheral 1 according to the present invention are driven by the single motor 17. The components include the photoconductor drums 59,65,66, and 67, the charge roller 60, the development units 61*a*, 61*b*, 61*c*, and 61*d*, the tension rollers 68 and 69, the fixing belt 71, the pressing roller 72, the feed rollers 73 and 74, the ejection rollers ER.

In such a configuration in which the photoconductor drums 59, 65, 66, and 67 and the other components are driven by the single motor 17, the single motor 17 may be driven for an operation other than image formation.

The single motor 17 is driven for an operation other than image formation, for example, during transportation and output of the recording medium 31, temperature control (warm-up) of the fixing device 2 for fixing of the recording medium 31, toner feeding operation, warm-up for development (idling for start charging the toner), and switching of the transfer position of the color machine.

In such a case, the motor 17 needs also to drive the photoconductor drums 59, 65, 66, and 67. Therefore, the photoconductor drums 59, 65, 66, and 67 may wear excessively.

As illustrated in FIG. 4, when the photoconductor drum 59 rotates, the cleaning blade 63*a* scrapes the surface of the photoconductor drum 59. Therefore, the film on the surface of the photoconductor drum 59 is scraped, and the film loss increases.

To prevent unwanted toner from being developed, the photoconductor drum 59 needs to be driven while the surface of the photoconductor drum 59 is charged to a surface potential Vd at which the toner does not adhere.

In general, the amount of wear of the photoconductor drum 59 tends to increase exponentially as the voltage of the photoconductor drum 59 increases, and the amount of wear of the photoconductor drum 59 when a voltage lower than the discharge start voltage is applied is known to be about 20% of the normal amount. For example, when the photoconductor drum 59 is driven to print approximately 100,000 sheets with a surface potential of −600 V, the photoconductor drum 59 wears approximately 12 μm. When the photoconductor drum 59 is driven to print approximately 100,000 sheets while a voltage lower than the discharge start voltage is applied, the photoconductor drum 59 wears approximately 2 μm.

This is because it is presumed that the higher the charge voltage, the greater the effect of energization fatigue due to the current flowing into the photoconductor drum 59, and thereby the film loss of the photoconductor drum 59 increases.

Note that the amount of wear of the photoconductor drum 59 is not limited to that corresponding to the values described above because the amount of wear varies depending on the system conditions of the photoconductor drum process and the composition or material, etc., of the photoconductor drum 59. The system conditions may include the voltage applied to the photoconductor drum 59 and the composition of the cleaning blade 63*a*.

No charge voltage may be applied to avoid the effect of wear of the photoconductor drum 59 caused by the applying or discharge of the charge voltage. However, in such a case, the transfer of the developing agent 612*a* to the photoconductor drum 59 is not prevented. Therefore, the developing agent 612*a* is consumed more than necessary.

When the digital multifunction peripheral 1, which is configured by contact charging by the charge roller 60, etc., stops abnormally, a reverse current is generated through the charge roller 60, and thereby the high-voltage board may fail.

Improvement Points of Conventional Problems in by Digital Multifunction Peripheral 1 According to First Embodiment The improvement points of the conventional problem by the digital multifunction peripheral 1 according to the first embodiment will now be described with reference to FIGS. 6 to 8.

Figures 6A, 6B:
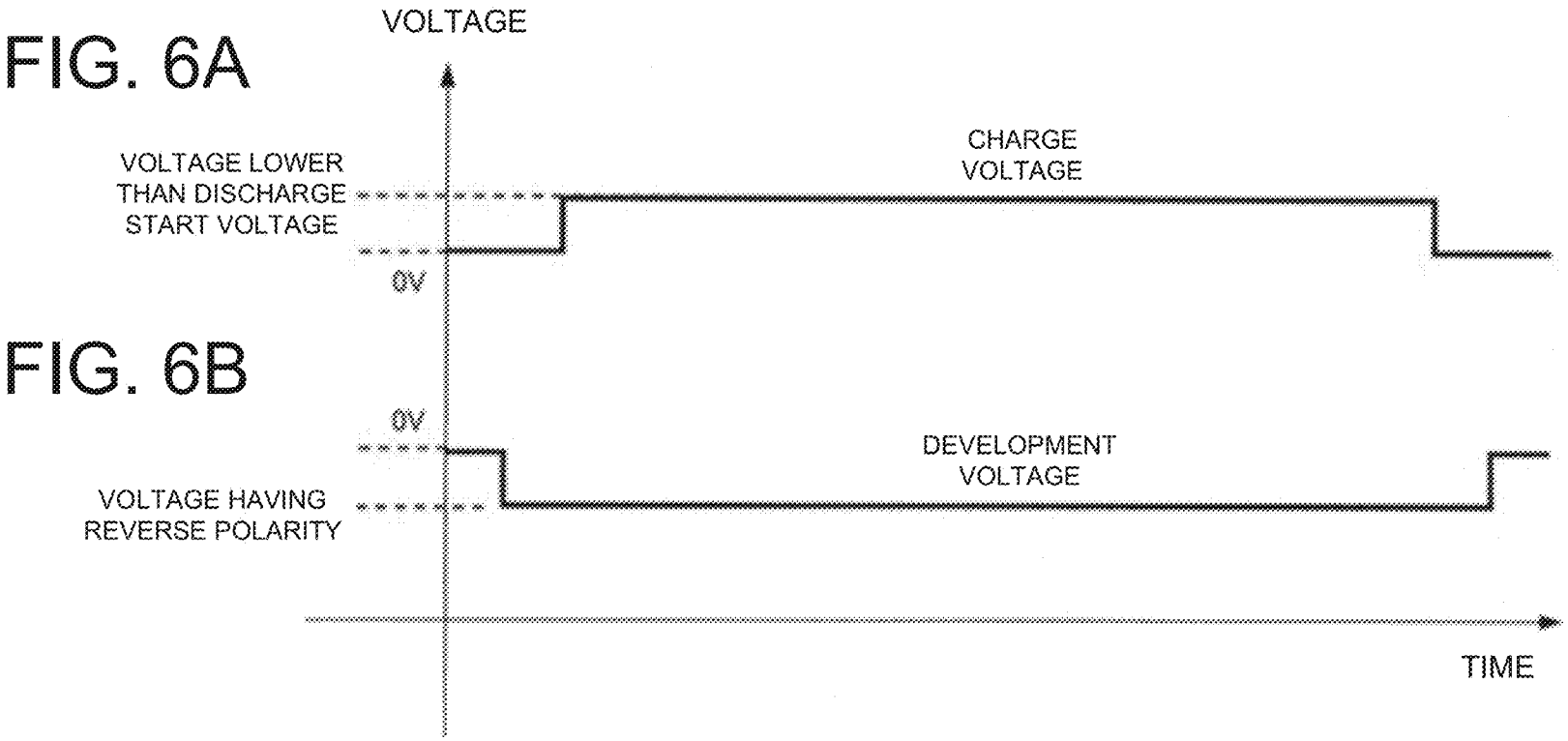
FIGS. 6A and 6B are example timing charts illustrating a temporal variation in voltages to be applied to the charge roller and the development roller illustrated in FIG. 4 during times other than the image formation.

The digital multifunction peripheral 1 according to the first embodiment solves the above-described problems by applying a charge voltage and a development voltage different from those applied during image formation so as to drive the motor 17 for an operation other than image formation as illustrated in FIGS. 6A and 6B.

FIGS. 6A and 6B are example timing charts illustrating a temporal variation in voltages to be applied to the charge roller 60 and the development roller 611*a* illustrated in FIG. 4 during times other than the image formation.

As illustrated in FIG. 6A, when the motor 17 is driven for an operation other than image formation, a predetermined charge voltage lower than the discharge start voltage (other than 0) is applied to the charge roller 60.

This suppresses the wear of the photoconductor drum 59, and thereby it is possible to extend the life of the photoconductor drum 59. By applying a charge voltage lower than the discharge start voltage, it is possible to prevent a reverse current from flowing into the board, without a protection circuit.

As illustrated in FIG. 6B, by applying a voltage having a polarity opposite to that at the time of image formation, as the development voltage, it is possible to prevent unnecessary consumption and contamination of the developing agent 612*a*.

An example operation of the digital multifunction peripheral 1 in response to reception of a drive request for the photoconductor drum 59 will now be described with reference to FIG. 7. FIG. 7 is a flowchart illustrating an example operation of the digital multifunction peripheral 1 in response to reception of a drive request for the photoconductor drum 59 illustrated in FIG. 4.

Figure 7:
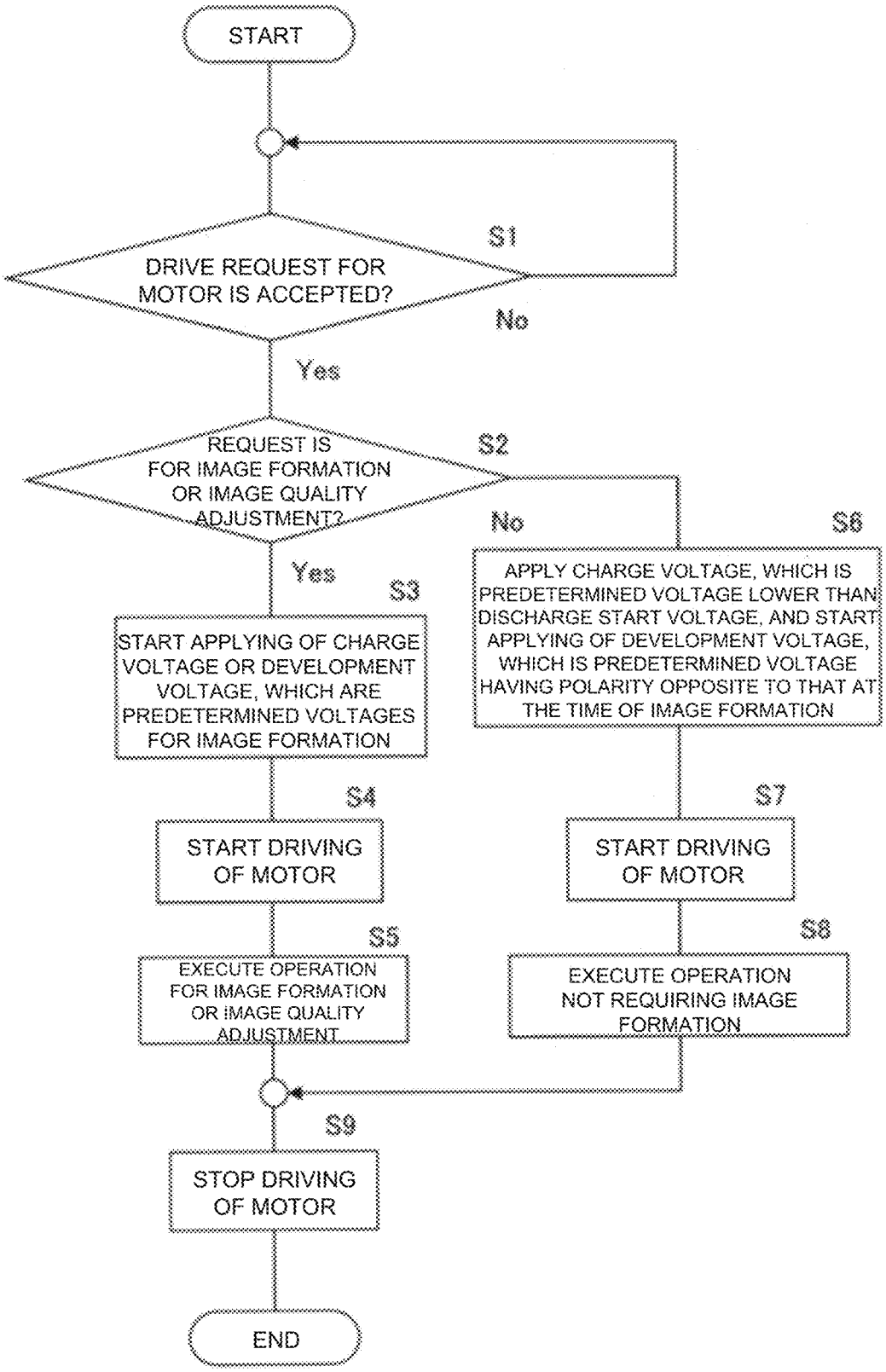
FIG. 7 is a flowchart illustrating an example operation of the digital multifunction peripheral in response to reception of a drive request for a photoconductor drum illustrated in FIG. 4.

In step S1 in FIG. 7, the controller 10 determines whether or not a drive request for the motor 17 has been accepted (step S1). For example, when an execution command such as image formation, image quality adjustment, sheet transport, or idling for temperature control is received, the controller 10 determines that the drive request for the motor 17 has been received.

If the drive request for the motor 17 is accepted (Yes in step S1), the controller 10 determines, in step S2, whether or not the drive request for the motor 17 is a request related to image formation or image quality adjustment (step S2).

If a drive request for the motor 17 is not accepted (No in step S1), the controller 10 causes the process to return to step S1 (step S1).

In step S2, if the drive request for the motor 17 is a request related to image formation or image quality adjustment (Yes in step S2), the controller 10 starts applying a charge voltage that is a predetermined voltage for image formation in step S3 (step S3).

In step S4, the controller 10 starts driving the motor 17 (step S4).

In step S5, the controller 10 executes an operation for image formation or image quality adjustment (step S5).

After the predetermined operation has been completed, in step S9, the controller 10 stops the driving of the motor 17 (step S9) and ends the processing.

In step S2, if the drive request for the motor 17 is not a request related to image formation or image quality adjustment (No in step S2), in step S6, the controller 10 applies a charge voltage, which is a predetermined voltage lower than the discharge start voltage, and starts the applying of a development voltage, which is a predetermined voltage having a polarity opposite to that at the time of image formation (step S6).

In step S7, the controller 10 starts driving the motor 17 (step S7).

In step S8, the controller 10 executes an operation corresponding to the received execution command, not requiring image formation (step S8).

After the predetermined operation has been completed, in step S9, the controller 10 stops the driving of the motor 17 (step S9) and ends the processing.

The discharge start voltage from the charge roller 60 to the photoconductor drum 59 is calculated, for example, as follows.

Figure 8:
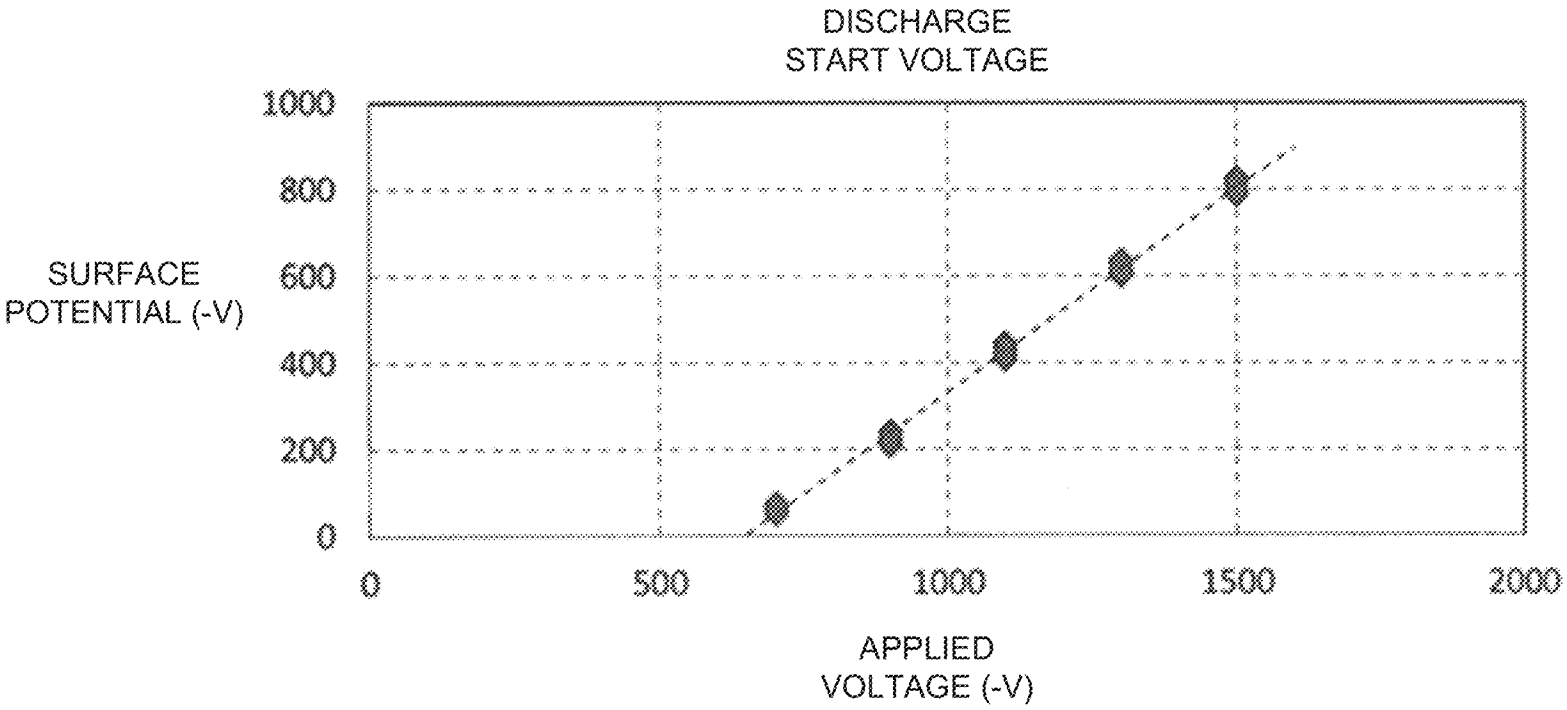
FIG. 8 is an example graph illustrating a relation between a voltage applied to a charge roller and a surface potential of a photoconductor drum.

FIG. 8 is an example graph illustrating a relation between a voltage applied to the charge roller 60 and a surface potential Vd of the photoconductor drum 59. In FIG. 8, the horizontal axis represents the voltage (−V) applied to the charge roller 60, and the vertical axis represents the surface potential Vd (−V) of the photoconductor drum 59.

In the graph in FIG. 8, the relation between the applied voltage and the surface potential is approximated, and the applied voltage x (V) of the charge roller 60 at which the surface potential y (−V) of the photoconductor drum 59 is 0 V is the discharge start voltage to be obtained.

Note that the discharge start voltage varies depending on the compositions of the charge roller 60 and the photoconductor drum 59.

As a result, the wear of the photoconductor drum 59 is suppressed by approximately 30% compared with the conventional technology. Also, problems such as a failure of the board does not occur.

Even when the single motor 17 drives the entire drive system of the digital multifunction peripheral 1 for an operation unrelated to image formation or image quality control, it is possible to provide a digital multifunction peripheral 1 that suppresses the deterioration of the photoconductor drum 59, such as a film loss, and prevents a reverse current flowing to the board.

Second Embodiment

An operation in response to reception of a drive request for the photoconductor drum 59 in a digital multifunction peripheral 1 according to a second embodiment of the present will now be described with reference to FIG. 9.

The configuration of the digital multifunction peripheral 1 according to the second embodiment is the same as that of the first embodiment, so the description thereof will be omitted.

In the following description, the photoconductor drum 59 and the charge roller 60 of the first visible-image forming unit 51 will be described as examples. The same description applies to also the second to fourth visible-image forming units 52 to 54.

In the digital multifunction peripheral 1 according to the first embodiment, the surface potential Vd of the photoconductor drum 59 relative to the voltage applied to the charge roller 60 depends on the thickness of the photoconductor drum 59. Therefore, when the photoconductor drum 59 wears due to film loss, the voltage to be applied to the charge roller 60 also changes in accordance with the degree of wear.

If an inappropriate voltage continues to be applied to the charge roller 60 without reflecting the wear of the photoconductor drum 59, the toner may adhere to the base of the output recording medium 31.

In order to solve such a problem in the second embodiment, the amount of film loss in the photoconductor drum 59 is predicted in accordance with the drive amount of the photoconductor drum 59, and the voltage to be applied to the charge roller 60 is corrected.

Figure 9:
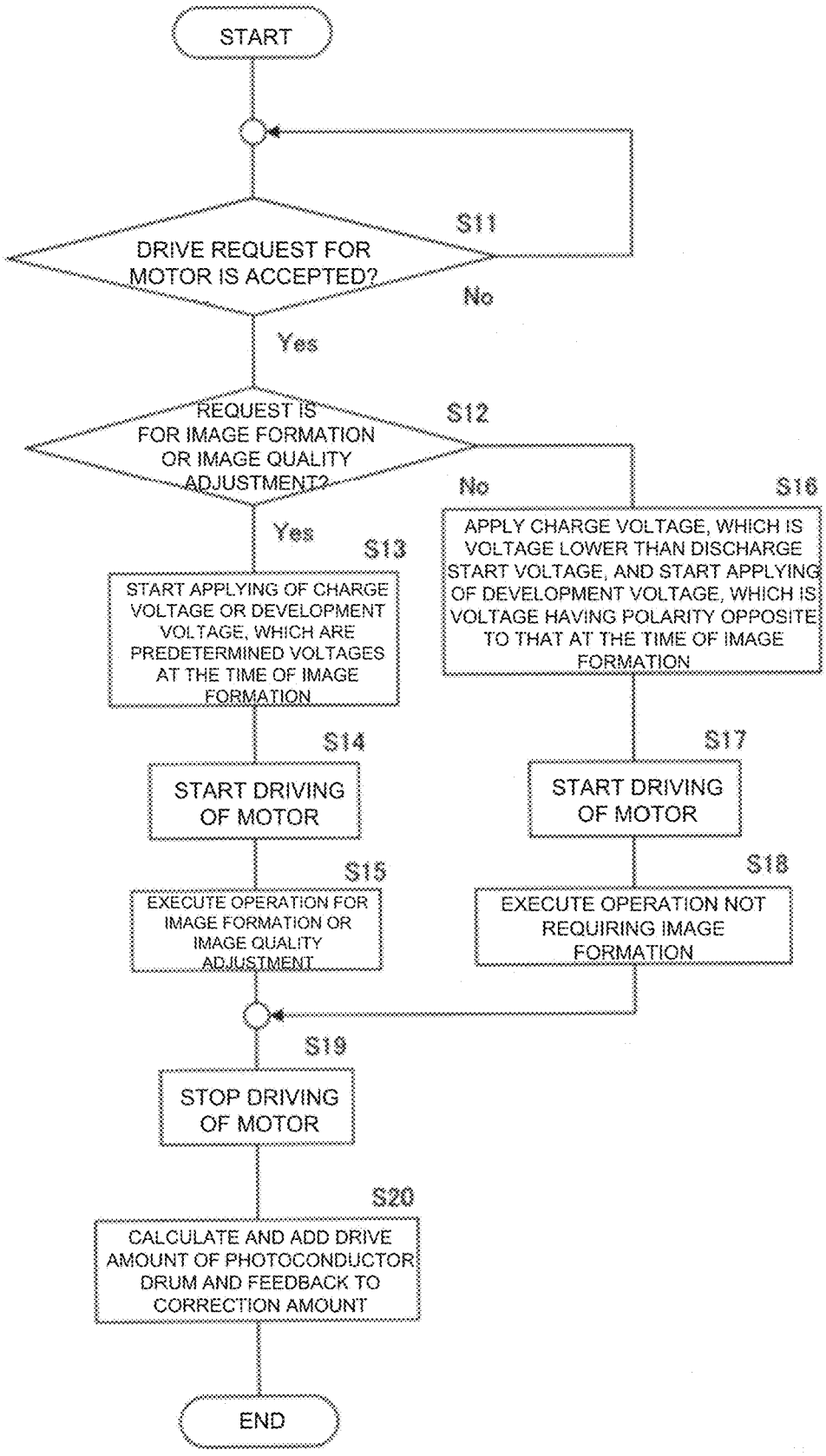
FIG. 9 is a flowchart illustrating an example operation in response to reception of a drive request for a photoconductor drum in a digital multifunction peripheral according to a second embodiment of the present invention.

FIG. 9 is a flowchart illustrating an example operation in response to reception of a drive request for the photoconductor drum 59 in the digital multifunction peripheral 1 according to the second embodiment of the present invention.

Note that the processing of steps S11 to S19 in FIG. 9 corresponds to the processing of steps S1 to S9 in FIG. 7, so the description thereof is omitted. Here, the processing of step S20, which is not illustrated in FIG. 7, will be explained.

After the driving of the motor 17 is stopped in step S19 of FIG. 9 (step S19), in step S20, the controller 10 calculates the drive amount of the photoconductor drum 59 and adds a predetermined coefficient in accordance with the voltage applied to the charge roller 60 to the drive amount (step S20). The charge voltage is then corrected on the basis of the value obtained in this way.

FIG. 10 illustrates example coefficients predetermined in accordance with the voltage applied to the charge roller 60 in the digital multifunction peripheral 1 according to the second embodiment of the present invention.

In FIG. 10, when the charge voltage is lower than the discharge start voltage, a coefficient of 0.6 is added to the drive amount of the photoconductor drum 59, and when the charge voltage is higher than or equal to the discharge start voltage, a coefficient of 1.0 is added to the drive amount of the photoconductor drum 59.

In this way, in the digital multifunction peripheral 1 in which the entire drive system is driven by the single motor 17, the charge voltage is corrected on the basis of a value obtained by weight depending on the voltage to be applied to the charge roller 60 added to the drive amount of the photoconductor drum 59.

As a result, it is possible to predict the precise amount of film loss of the photoconductor drum 59 and control the appropriate charge voltage to the charge roller 60 in accordance with the amount of film loss. Thereby a digital multifunction peripheral 1 is provided that is able to prevent unnecessary toner consumption and contamination.

Third Embodiment

An operation in response to reception of a drive request for the photoconductor drum 59 in a digital multifunction peripheral 1 according to a third embodiment of the present will now be described with reference to FIG. 11.

The configuration of the digital multifunction peripheral 1 according to the third embodiment is the same as that of the first embodiment, so the description thereof will be omitted.

In the following description, the photoconductor drum 59 and the charge roller 60 of the first visible-image forming unit 51 will be described as examples. The same description applies to also the second to fourth visible-image forming units 52 to 54.

In the digital multifunction peripheral 1 according to the first embodiment, when a voltage lower than the discharge start voltage is applied to the charge roller 60 to drive the charge roller 60 for an operation other than image formation, the voltage is not applied to the transfer roller 621*a* in contact with the photoconductor drum 59 via the intermediate transfer belt 55.

Some of the toners of the developing agent 612*a* has a low charge. Thus, the toner with less charge may adhere to the photoconductor drum 59.

The small amount of the toner adhering to the photoconductor drum 59 may accumulate on the intermediate transfer belt 55 and become dirty. As a result, unwanted toner may adhere to the output recording medium 31.

To solve such a problem in the third embodiment, a voltage having a polarity opposite to that at the time of image formation is applied to the transfer roller 621*a* that is in contact with the photoconductor drum 59 via the intermediate transfer belt 55, and thereby the small amount of toner adhering to photoconductor drum 59 is prevented from transferring to the intermediate transfer belt 55.

Figure 11:
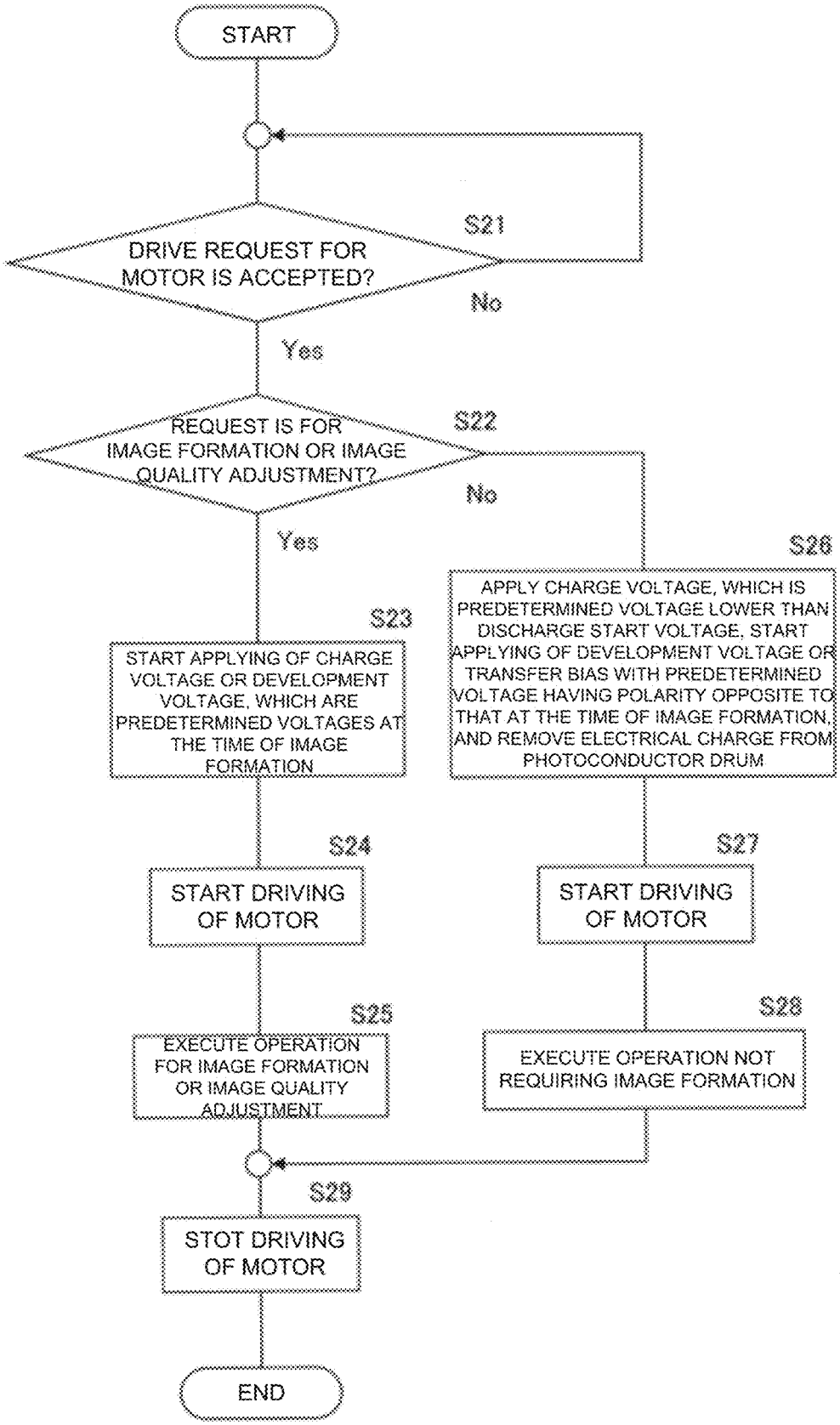
FIG. 11 is a flowchart illustrating an example operation in response to reception of a drive request for a photoconductor drum in a digital multifunction peripheral according to a third embodiment of the present invention.

FIG. 11 is a flowchart illustrating an example operation in response to reception of a drive request for the photoconductor drum 59 in the digital multifunction peripheral 1 according to the third embodiment of the present invention.

Note that the processing of steps S21 to S25 and S27 to S29 in FIG. 11 corresponds to the processing of steps S1 to S5 and S7 to S9 in FIG. 7, so the description thereof is omitted. Here, the processing of step S26 which is not included in FIG. 7 will be explained.

In step S22, if the drive request for the motor 17 is not a request related to image formation or image quality adjustment (No in step S22), in step S26, the controller 10 starts the applying of a charge voltage, which is a predetermined voltage lower than the discharge start voltage, and the applying of a development voltage and a transfer voltage, which are predetermined voltages having a polarity opposite to that at the time of image formation (step S26).

When the photoconductor drum 59 is charged by the voltage applied to the transfer roller 621*a*, the potential difference between the development voltage applied to prevent unnecessary toner from adhering to the photoconductor drum 59 and the surface potential Vd of the photoconductor drum 59 shifts from a target value, and thereby unwanted toner may adhere to the photoconductor drum 59.

Therefore, the neutralization unit 76 also removes the electrical charges from the photoconductor drum 59 (step S26).

Even when the single motor 17 drives the entire drive system of the digital multifunction peripheral 1 for an operation unrelated to image formation or image quality control, it is possible to provide a digital multifunction peripheral 1 that suppresses the deterioration of the photoconductor drum 59, such as a film loss.

Fourth Embodiment

Switching of the contact states of the intermediate transfer belt 55 and the four photoconductor drums 59, 65, 66, and 67 in a digital multifunction peripheral 1 according to a fourth embodiment of the present will now be described with reference to FIGS. 12A to 12C.

Figure 12A:
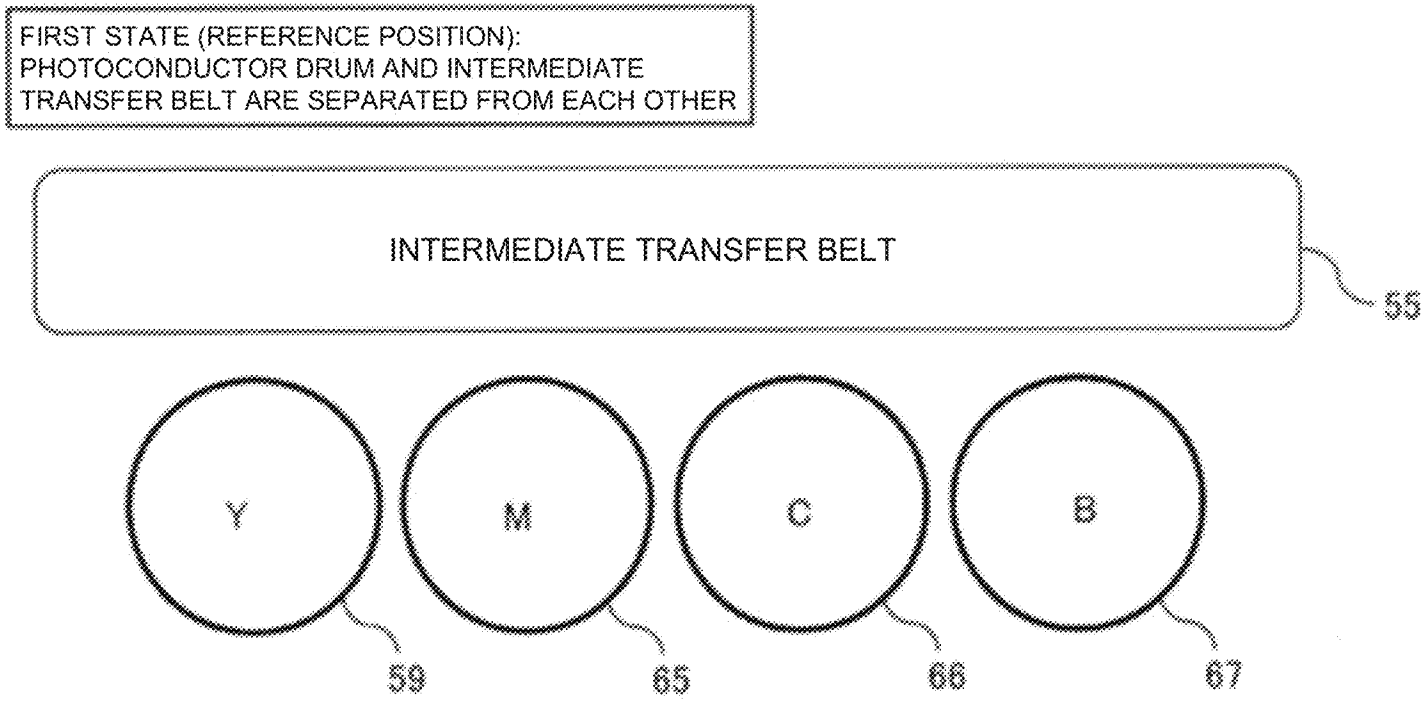
FIGS. 12A to 12C are explanatory diagrams illustrating the switching of contact states of an intermediate transfer belt and four photoconductor drums in a digital multifunction peripheral according to a fourth embodiment of the present invention, where
Figure 12B:
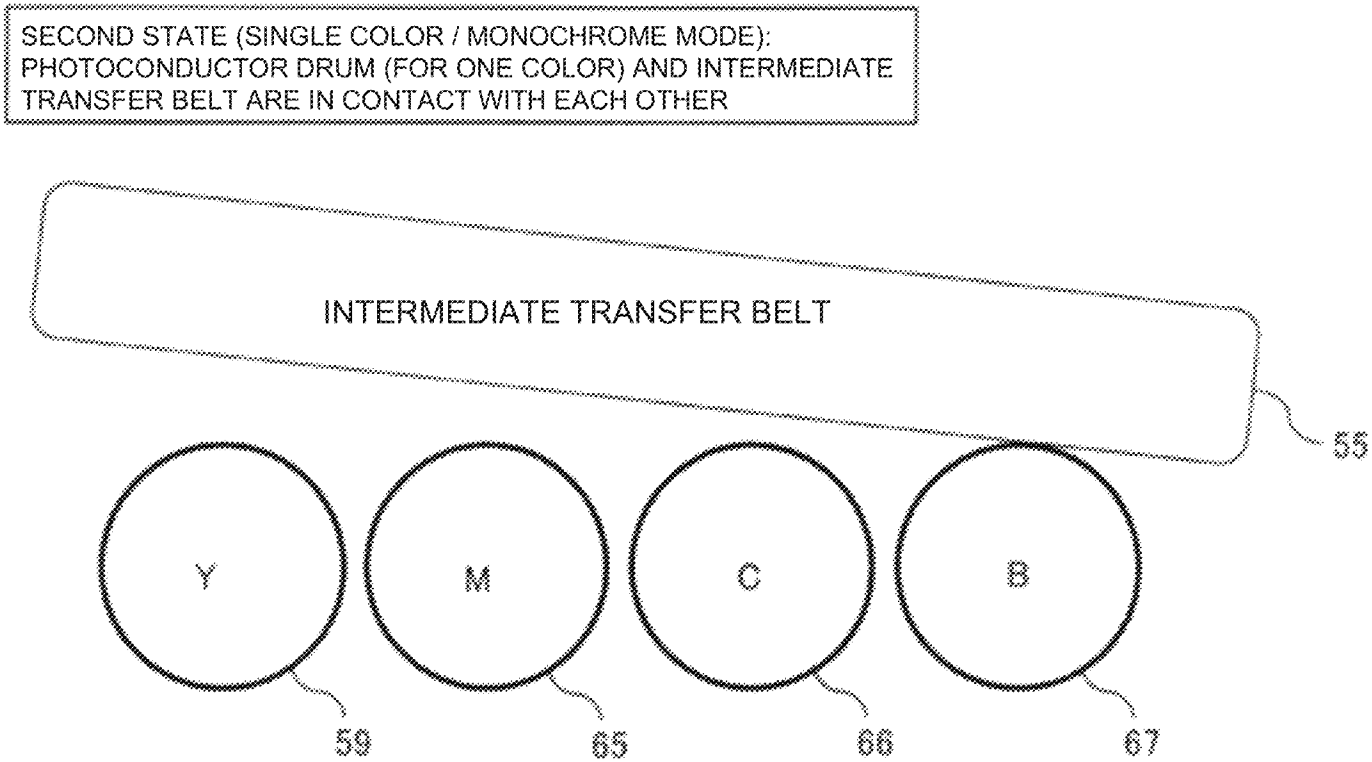
Figure 12C:
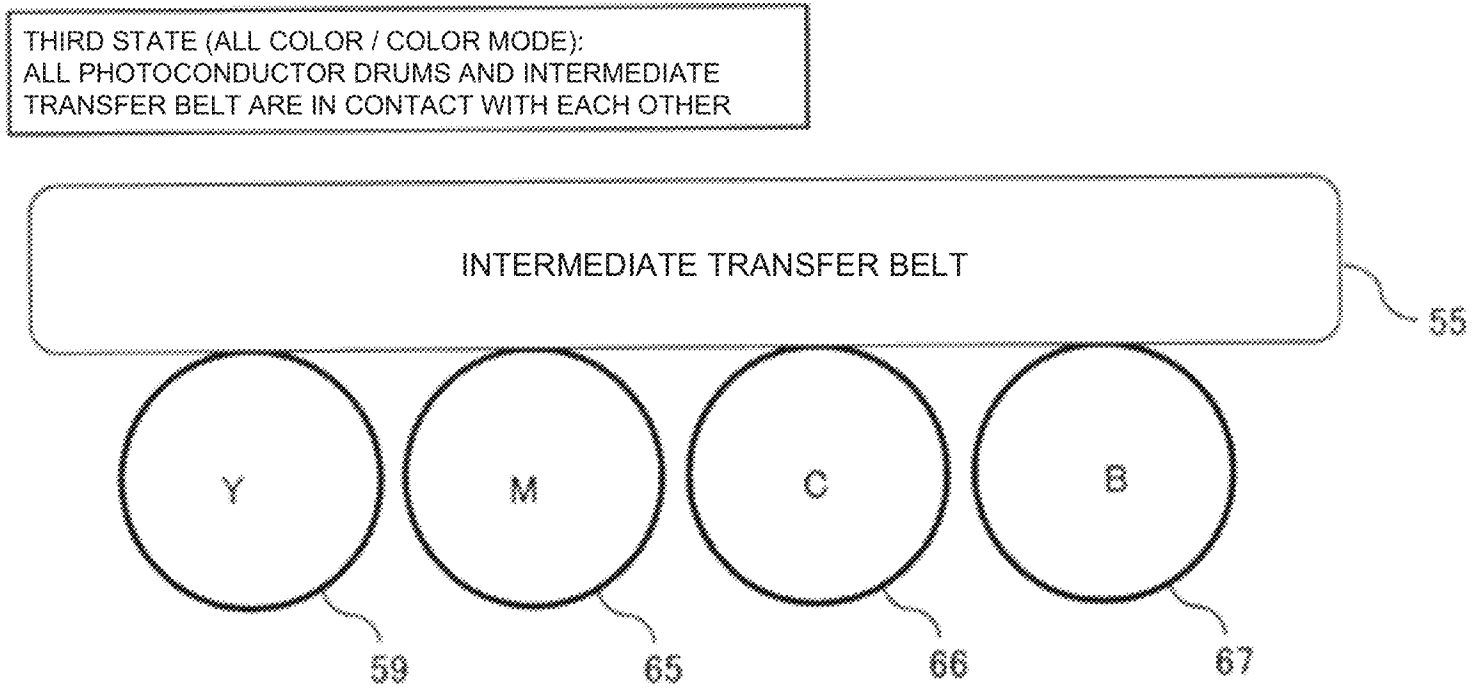

FIGS. 12A to 12C are explanatory diagrams illustrating the switching of the contact states between the intermediate transfer belt 55 and the four pairs of photoconductor drums 59, 65, 66, 67 in the digital multifunction peripheral 1 according to the fourth embodiment of the present invention.

FIG. 12A illustrates a state in which the intermediate transfer belt 55 and the four photoconductor drums 59, 65, 66, and 67 are separated from each other. FIG. 12B illustrates a state in which the intermediate transfer belt 55 and the black photoconductor drum 67 are in contact with each other. FIG. 12C illustrates a state in which the intermediate transfer belt 55 and four photoconductor drums 59, 65, 66, and 67 are in contact with each other.

In the fourth embodiment, the intermediate transfer belt 55 is configured to capable of coming into contact with and being separated from the four photoconductor drums 59, 65, 66, and 67.

As illustrated in FIGS. 12A to 12C, the controller 10 controls the contact state of the intermediate transfer belt 55 and the four photoconductor drums 59, 65, 66, and 67 so as to switch between a first state (FIG. 12A), a second state (FIG. 12B), and a third state (FIG. 12C) in a predetermined order. In the first state, the intermediate transfer belt 55 and the four photoconductor drums 59, 65, 66, and 67 are separated (FIG. 12A). In the second state, only the black photoconductor drum 67 is in contact with the intermediate transfer belt 55 (FIG. 12B). In the third state, the photoconductor drums 59, 65, 66, and 67 of different colors are all in contact with the intermediate transfer belt 55 (FIG. 12C).

Specifically, the controller 10 causes the contact states of the intermediate transfer belt 55 to transition in the order of FIGS. 12A, 12B, and 12C by rotating a cam (not illustrated).

Note that the transition is not limited to the order of FIGS. 12A, 12B, and 12C. For example, the transition may be in the order of FIGS. 12A, 12C, and 12B, and the cam may rotate in only one direction to reduce the costs involving the configuration.

The following are examples of the transition.

Transition Example 1

In transition example 1, the controller 10 causes the contact states of the intermediate transfer belt 55 to transition from the first state (reference position) (FIG. 12A) to the second state (FIG. 12B) and then the third state (FIG. 12C).

That is, after printing has been performed in the second state (FIG. 12B), the intermediate transfer belt 55 comes into contact with all photoconductor drums in the third state (FIG. 12C). The intermediate transfer belt 55 then continues to shift to the reference position, where the intermediate transfer belt 55 stops (FIG. 12A).

Transition Example 2

In transition example 2, the controller 10 causes the contact states of the intermediate transfer belt 55 and the photoconductor drums to transition from the second state (FIG. 12B) to the third state (FIG. 12C), the first state (reference position) (FIG. 12A), and the second contact state (FIG. 12B) in this order.

When a paper jam or image density adjustment occurs during printing in the second state (FIG. 12B), the intermediate transfer belt 55 enters the third state (FIG. 12C) and then the first state (FIG. 12A). After cleaning has been performed in the first state (FIG. 12A), printing is performed again in the second state (FIG. 12B).

Transition Example 3

In transition example 3, the controller 10 causes the contact states of the intermediate transfer belt 55 to transition from the second state (FIG. 12B) to the first state (reference position) (FIG. 12A), the third state (FIG. 12C), and the second state (FIG. 12B) in this order.

When a paper jam or image density adjustment occurs during printing in the second state (FIG. 12B), the intermediate transfer belt 55 enters the first state (FIG. 12A). After cleaning has been performed in the first state (FIG. 12A), the intermediate transfer belt 55 enters the third state (FIG. 12C). Printing is then performed again in the second state (FIG. 12B).

During the transition from the second state (FIG. 12B) to the third state (FIG. 12C) in the transition examples 1 and 2 described above and the transition from the first state (FIG. 12A) to the third state (FIG. 12C) in transition example 3, the photoconductor drums 65, 66, and 67 need to be driven so as to prevent scratches on the photoconductor drums 65, 66, and 67.

To suppress unnecessary toner consumption, it is necessary to establish a predetermined potential difference between the photoconductor drums 65, 66, and 67 and the corresponding development units 61*b*, 61*c*, and 61*d*.

When the electric potential on the photoconductor drums 59, 65, 66, and 67 is to be raised, it is necessary to gradually increase the applied voltage to a level that is the same as the output during printing. Therefore, time is required to wait for the rise of the electric potential on photoconductor drums 59, 65, 66, and 67. However, by driving the photoconductor drums 59, 65, 66, and 67 below the discharge start voltage, the above wait time becomes unnecessary, and the required time is reduced. Since no discharge is performed, the energization fatigue of the photoconductor drums 59, 65, 66, 67 is suppressed, and wear is suppressed.

A preferred embodiment of the present invention also includes a combination of any of the above-mentioned embodiments. Various modified examples of the present invention may be provided besides the above-described embodiments. These modifications is not construed as not belonging to the scope of the present invention. The invention includes the meaning equivalent to the claims and all modifications within the scope.

REFERENCE SIGNS LIST

1: digital multifunction peripheral
2: fixing device
10: controller
11: image reader
12: image forming device
13: memory
14: image processor
15: communication device
16: transporter
17: motor
18: panel unit
19: power supply
20: voltage applier
31: recording medium
50: optical system unit
51: first visible-image forming unit
52: second visible-image forming unit
53: third visible-image forming unit
54: fourth visible-image forming unit
55: intermediate transfer belt
56: secondary transfer unit
57: internal sheet feeding unit
58: manual sheet feeding unit
59,65,66,67: photoconductor drum
60: charge roller
61,61*a*, 61*b*, 61*c*, 61*d*: development unit
62,62*a*, 62*b*, 62*c*, 62*d*: primary transfer unit
63: cleaning unit
63*a*: cleaning blade
64: laser light source
68, 69: tension roller
70: waste toner box
71: fixing belt
72: pressing roller
73, 74: feed roller
75: sheet receiving tray
76: neutralization unit
77: cleaning roller
121: LSU
181: display operating device
182: physical operating device
191: charge power supply
192: development power supply
201: charge voltage applier
202: development voltage applier
601: core metal
611*a*: development roller
612*a*: developing agent
613*a*: core metal
621*a*: transfer roller
ER: ejection roller
R1, R2: rotation direction
RT1, RT2, RT3, RT4: transport route
Vb: potential
Vd, VL: surface potential

What is claimed is:

1. An image forming apparatus comprising:

a photoconductor;

a charger that comes into contact with the photoconductor and charges the photoconductor;

a charge voltage applier that applies a first charge voltage and a second charge voltage, which are predetermined, to the charger;

an exposure device that forms an electrostatic latent image on the photoconductor;

a development device that supplies a toner to the photoconductor and forms a toner image corresponding to the electrostatic latent image;

a development voltage applier that applies a first development voltage and a second development voltage, which are predetermined, to the development device;

a transfer device that transfers the toner image onto a recording medium via a transfer belt;

a fixing device that heats and fixes the toner image on the recording medium by a fixing roller;

a transporter that transports the recording medium;

a motor that drives the photoconductor simultaneously with more than at least one of the transfer device, the fixing device, and the transporter; and a controller that controls the photoconductor, the charger, the charge voltage applier, the exposure device, the development device, the development voltage applier, the transfer device, the fixing device, the transporter, and the motor, and forms an image, wherein, when the motor is driven for image formation, the controller applies the first charge voltage set for image formation to the charge voltage applier and the first development voltage set for image formation to the development voltage applier, when the motor is driven for an operation other than image formation, the controller applies the second charge voltage set for the operation other than image formation to the charge voltage applier and the second development voltage set for the operation other than image formation to the development voltage applier, and wherein the second charge voltage includes a predetermined voltage lower than a discharge start voltage at which a potential of the photoconductor is 0 V, and the second development voltage includes a predetermined voltage having a polarity opposite to the polarity of the first development voltage.

2. The image forming apparatus according to claim 1, wherein the photoconductor includes a plurality of photoconductors corresponding to black toner and color toners, respectively, the transfer device includes an intermediate transfer body that is capable of switching between three contact states of the transfer device and the plurality of photoconductors, the three contact states including a first state in which the transfer device is separated from all color photoconductors, a second state in which the transfer device is in contact with the black photoconductor, and a third state in which the transfer device is in contact with all color photoconductors, and the controller causes the three contact states of the intermediate transfer body to switch in a predetermined order.

3. An image forming apparatus comprising:

a photoconductor;

a charger that comes into contact with the photoconductor and charges the photoconductor;

a charge voltage applier that applies a first charge voltage and a second charge voltage, which are predetermined, to the charger;

an exposure device that forms an electrostatic latent image on the photoconductor;

a development device that supplies a toner to the photoconductor and forms a toner image corresponding to the electrostatic latent image;

a development voltage applier that applies a first development voltage and a second development voltage, which are predetermined, to the development device;

a transfer device that transfers the toner image onto a recording medium via a transfer belt;

a fixing device that heats and fixes the toner image on the recording medium by a fixing roller;

a transporter that transports the recording medium;

a motor that drives the photoconductor simultaneously with more than at least one of the transfer device, the fixing device, and the transporter; and a controller that controls the photoconductor, the charger, the charge voltage applier, the exposure device, the development device, the development voltage applier, the transfer device, the fixing device, the transporter, and the motor, and forms an image, wherein, when the motor is driven for image formation, the controller applies the first charge voltage set for image formation to the charge voltage applier and the first development voltage set for image formation to the development voltage applier, when the motor is driven for an operation other than image formation, the controller applies the second charge voltage set for the operation other than image formation to the charge voltage applier and the second development voltage set for the operation other than image formation to the development voltage applier, and wherein the controller causes the charge voltage applier to correct the first charge voltage and the second charge voltage based on a value obtained by calculating an amount of drive of the photoconductor and adding a predetermined coefficient, in accordance with the first charge voltage and the second charge voltage, with the amount of drive.

4. The image forming apparatus according to claim 3, wherein the photoconductor includes a plurality of photoconductors corresponding to black toner and color toners, respectively, the transfer device includes an intermediate transfer body that is capable of switching between three contact states of the transfer device and the plurality of photoconductors, the three contact states including a first state in which the transfer device is separated from all color photoconductors, a second state in which the transfer device is in contact with the black photoconductor, and a third state in which the transfer device is in contact with all color photoconductors, and the controller causes the three contact states of the intermediate transfer body to switch in a predetermined order.

5. An image forming apparatus comprising:

a photoconductor;

a charger that comes into contact with the photoconductor and charges the photoconductor;

a charge voltage applier that applies a first charge voltage and a second charge voltage, which are predetermined, to the charger;

an exposure device that forms an electrostatic latent image on the photoconductor;

a development device that supplies a toner to the photoconductor and forms a toner image corresponding to the electrostatic latent image;

a development voltage applier that applies a first development voltage and a second development voltage, which are predetermined, to the development device;

a transfer device that transfers the toner image onto a recording medium via a transfer belt;

a fixing device that heats and fixes the toner image on the recording medium by a fixing roller;

a transporter that transports the recording medium;

a motor that drives the photoconductor simultaneously with more than at least one of the transfer device, the fixing device, and the transporter;

a photoconductor neutralizer that removes charges from the photoconductor;

a transfer applier that applies a first transfer voltage and a second transfer voltage, which are predetermined, to the transfer device, and a controller that controls the photoconductor, the charger, the charge voltage applier, the exposure device, the development device, the development voltage applier, the transfer device, the fixing device, the transporter, and the motor, and forms an image, wherein, when the motor is driven for image formation, the controller applies the first charge voltage set for image formation to the charge voltage applier and the first development voltage set for image formation to the development voltage applier, when the motor is driven for an operation other than image formation, the controller applies the second charge voltage set for the operation other than image formation to the charge voltage applier and the second development voltage set for the operation other than image formation to the development voltage applier, when the motor is driven for image formation, the controller causes the transfer applier to apply the first transfer voltage set for image formation and causes the photoconductor neutralizer to remove charges from the photoconductor, when the motor is driven for the operation other than image formation, the controller causes the transfer applier to apply the second transfer voltage set for the operation other than image formation and causes the photoconductor neutralizer to remove charges from the photoconductor, and the second transfer voltage includes a predetermined voltage having a polarity opposite to the polarity of the first transfer voltage.

6. The image forming apparatus according to claim 5, wherein the photoconductor includes a plurality of photoconductors corresponding to black toner and color toners, respectively, the transfer device includes an intermediate transfer body that is capable of switching between three contact states of the transfer device and the plurality of photoconductors, the three contact states including a first state in which the transfer device is separated from all color photoconductors, a second state in which the transfer device is in contact with the black photoconductor, and a third state in which the transfer device is in contact with all color photoconductors, and the controller causes the three contact states of the intermediate transfer body to switch in a predetermined order.

* * * * *